US007975664B2

(12) United States Patent
Himsel et al.

(10) Patent No.: US 7,975,664 B2
(45) Date of Patent: Jul. 12, 2011

(54) VALVE DRIVE HAVING A MECHANICAL VALVE PLAY POSITION AND METHOD FOR THE MOUNTING THEREOF

(75) Inventors: Frank Himsel, Obermichelbach (DE); Wolfgang Christgen, Seukendorf (DE)

(73) Assignee: Schaeffler KG, Herzogenaurach (DE)

( * ) Notice: Subject to any disclaimer, the term of this patent is extended or adjusted under 35 U.S.C. 154(b) by 351 days.

(21) Appl. No.: 12/064,934

(22) PCT Filed: Jul. 27, 2006

(86) PCT No.: PCT/EP2006/007434

§ 371 (c)(1),
(2), (4) Date: Mar. 10, 2008

(87) PCT Pub. No.: WO2007/025616

PCT Pub. Date: Mar. 8, 2007

(65) Prior Publication Data

US 2008/0216784 A1 Sep. 11, 2008

(30) Foreign Application Priority Data

Aug. 27, 2005 (DE) ..... 10 2005 040 694

(51) Int. Cl.
*F01L 1/02* (2006.01)

(52) U.S. Cl. ..... 123/90.27; 123/90.39; 74/559

(58) Field of Classification Search ..... 123/90.27, 123/90.43, 90.44, 90.45, 90.39, 90.41; 74/559, 74/569

See application file for complete search history.

(56) References Cited

U.S. PATENT DOCUMENTS

| | | | | |
|---|---|---|---|---|
| 4,658,770 | A * | 4/1987 | Okuyama et al. | 123/90.41 |
| 4,796,576 | A | 1/1989 | Matsuura et al. | |
| 4,979,475 | A | 12/1990 | Mills | |
| 6,047,675 | A * | 4/2000 | Kunz | 123/90.41 |

FOREIGN PATENT DOCUMENTS

| | | |
|---|---|---|
| DE | 197 46 877 A | 4/1998 |
| GB | 809 729 Y | 3/1959 |
| GB | 2 020 389 XY | 11/1979 |
| JP | 2000 161025 XY | 6/2000 |

* cited by examiner

*Primary Examiner* — Zelalem Eshete
(74) *Attorney, Agent, or Firm* — Lucas & Mercanti, LLP

(57) ABSTRACT

The valve drive has a cam follower (10) which is arranged between a cam (3) of a camshaft (4) and the gas exchange valve (5) and is mounted on a support element (8). Support element (8) is stationary in cylinder head (2), with a rigid installation height (feature YP), for the adjustment of the valve play (21) with respect to the cam (3) and/or the gas exchange valve (5). A module (6) which has the cam, follower (10) and the support element (8), defines total installation dimension of the module (6).

9 Claims, 4 Drawing Sheets

VALVE DRIVE HAVING A MECHANICAL VALVE PLAY POSITION AND METHOD FOR THE MOUNTING THEREOF

FIELD OF THE INVENTION

The invention relates to a valve drive for actuating a gas exchange valve in a cylinder head of an internal combustion engine with mechanical valve play adjustment, having a lever-like cam follower arranged between a cam of a camshaft and the gas exchange valve, which cam follower is mounted on a support element, which is stationary in the cylinder head, with a rigid installation height and, for the adjustment of the valve play with respect to the cam and/or the gas exchange valve, is dimensionally paired with the support element.

BACKGROUND OF THE INVENTION

A valve drive of said type can be gathered from JP 2000161025 A which is considered as being generic. Proposed in said document is a rocker arm valve drive whose valve play adjustment takes place by exchanging the support element for a different support element with an installation height corresponding to the nominal valve play. For this reason, and also on account of a lack of indications in said document which allow conclusions to be drawn regarding a dimensional relationship, with regard to the valve play, of the support element and the rocker arm in the non-assembled state outside the cylinder head, a person skilled in the art arrives at the result that even the initial assembly of said valve drive into the cylinder takes place in a conventional manner. On account of the complex kinematic conditions of the rocker arm valve drive, the level of valve play is determined or controlled here by means of direct measurement or testing of the free travel of the rocker arm relative to the cam or the gas exchange valve. A prerequisite for this is however that the valve drive is situated in a very advanced assembly state of the cylinder head, so that with the knowledge of the determined actual valve play or its deviation from the nominal valve play, the actual valve play adjustment, which is then often necessary, to the nominal valve play can take place only after renewed disassembly of the valve drive for the purpose of exchanging the support element. Said intermediate step of the provisional assembly of the valve drive into the cylinder head is however associated with a considerable level of time expenditure, and consequently with high production costs, in particular within the context of mass production assembly.

OBJECT OF THE INVENTION

It is therefore an object of the present invention to create a valve drive having a lever-like cam follower and mechanical valve play adjustment, and a method for assembling the valve drive, in which the above-specified disadvantages are eliminated. It should in particular be possible for the valve drive to be assembled into the cylinder head in a reliable manner with a considerably reduced level of time expenditure for the adjustment of the valve play in comparison with the prior art.

SUMMARY OF THE INVENTION

According to the invention, said object is achieved in terms of a device by means of the characterizing features of patent claim 1 and in terms of a method by means of the characterizing features of patent claim 7. Advantageous refinements and embodiments can be gathered from the subclaims. The concept on which the present invention is based is that of a module which comprises the cam follower and the support element and which can be mounted in the cylinder head and which is paired outside the cylinder head being provided, which module has a defined total installation dimension.

For better understanding of the concept of the invention, the term "total installation dimension" which is alternatively used is firstly explained at this point. The starting point for the explanation is a directly driven valve drive with mechanical valve play adjustment, in which the rotating lift of the cam is converted into a linear movement of the cam follower. Said valve drive type is known to a person skilled in the art in particular in the form of the frequently-used bucket tappet valve drives, in which the lifting movement of the bucket tappet takes place parallel to the longitudinal axis of the gas exchange valve. In the simplest case of a planar bucket base which runs perpendicular to said longitudinal axis, the valve play is then given by the difference between the spacing of the cam base circle to the cam-side end side of the gas exchange valve and the installation dimension of the bucket tappet, which corresponds to the thickness of the bucket base in the region of the gas exchange valve. Consequently, the kinematic conditions with regard to the valve play of said bucket tappet are to be considered as being one-dimensional, since the valve play is dependent only on the spacing of the cam base circle to the gas exchange valve and on said thickness of the bucket base. In this respect, it is also possible for an adjustment of the valve play during the initial assembly of a valve drive of said type into the cylinder head to take place in a time-saving manner in that, when the bucket tappet is not yet assembled, the spacing of the cam base circle to the end face of the gas exchange valve is determined, and the bucket tappet with a base thickness which corresponds to the nominal valve play which is to be set is subsequently assembled.

In contrast thereto, the valve drive according to the invention having the lever-like cam follower has considerably more complex kinematic properties. This is based firstly on the fact that a change in position of the lever centre of rotation on the support element leads already to a considerable change in valve play of the cam follower with respect to the cam or the gas exchange valve—a principle on which, in a known way, the mode of operation of support elements with a manually mechanically adjustable or automatically hydraulically adjustable centre of rotation are based. Secondly, component-tolerance-induced changes in position or changes in dimension of elements of the cam follower itself, which elements serve for the direct transmission of movement of the cam to the gas exchange valve, can lead to the valve play being considerably influenced. As a result, the adjustment of the valve play in the present valve drive requires a multi-dimensional consideration of the kinematic conditions. Said conditions are to be considered two-dimensional in the case of a gas exchange valve which is parallel to the pivot plane of the cam follower, and possibly even three-dimensional in the case of a gas exchange valve which is inclined with respect to the pivot plane. For this reason, for clarification of the present concept of the invention, the auxiliary variable the "total installation dimension" has been introduced which is to be understood as a replacement dimension with the following definition:

Modules which in each case comprise a lever-like cam follower and a support element and which are assembled in succession at the same position of the same cylinder head in connection with the same cam and the same gas exchange valve have, for an identical total installation dimension, the same valve play.

In addition, component-tolerance-induced spatial positions or dimensional dimensions of elements, which influence the valve play, of the valve drive are referred to below as features.

Since the module of the valve drive according to the invention has a given total installation dimension, the knowledge of the features of the cylinder head including the assembled gas exchange valve and the camshaft is sufficient to ensure an actual valve play within the nominal valve play already after the initial assembly of the valve drive into the cylinder head. The intermediate step, explained in the introduction, of the provisional assembly of the valve drive into the cylinder head for measuring or testing the actual valve play can therefore be dispensed with, as a result of which the level of expenditure conventional in the prior art for adjusting the valve play during the initial assembly of the cylinder head can be considerably reduced. In this regard, reference is made to the description of methods according to the invention for assembling the valve drive.

According to one preferred refinement of the invention, one or more groups of modules are provided, which modules have cam followers and support elements which are paired such that all the modules of the same group have a substantially identical total installation dimension, and that all the modules of another group have a different total installation dimension thereto. The sorting of the modules according to total installation dimension makes it possible to selectively assign a module, as a function of the cylinder-head-side features, to the individual valve drive which is to be assembled, that is to say the gas exchange valve and the associated cam, such that the actual valve play of the assembled individual valve drive lies within the limits of the nominal valve play without further adjustment measures.

It is alternatively also considered that only one group of modules is provided in connection with an adjusting means, which can be mounted separately from the module in the cylinder head, for adjusting the valve play. Here, the adjusting means can be embodied as an adjusting disk which is of stepped thickness or valve adjusting flap which is of stepped thickness or both. The adjusting disk is arranged between a base, which supports the support element, in the cylinder head and an end side, which faces towards the base, of the support element, while the valve adjusting flap is arranged between an end face, which faces towards the cam follower, of the gas exchange valve and a valve shank rest, which faces towards the end face, of the cam follower.

As is explained again below, said alternative possibility also leads to a considerable simplification of the assembly of the valve drive into the cylinder head. It is also sufficient in this case for only one group of modules to be produced, mounted and to be provided for assembly into the cylinder head, while the adjusting means which is sorted by thickness and is of comparatively small construction is simple and cost-effective both in terms of production and logistics.

In one preferred embodiment of the invention, the module should comprise a connecting element which serves for captively retaining the cam follower on the support element. In this way, the risk of cam followers and support elements which have already been grouped to form the modules becoming mixed up among one another during transport and assembly of the modules can be considerably reduced.

In addition, the cam follower of a module of said type, which is dimensionally and also mechanically related by means of the connecting element, should be embodied as a rocker arm which, with a convex valve shank rest at a first end region, actuates the gas exchange valve, with a spherical-cap-shaped formation at a second end region, is pivotably mounted on a spherical end of the support element and is acted on by means of a roller, which is rotatable and optionally mounted by means of rolling bearings, in a central region by the cam. Here, the connecting element, which, as a shaped part produced in a non-cutting process, is composed of cold-hammered sheet metal material, engages in a form-fitting manner around a diameter constriction below the spherical end. Alternatively, however, the cam follower can also be embodied as a tilting lever which, in a central region, is mounted on a support element which is arranged in a suspended fashion in the cylinder head.

The object specified in the introduction is also achieved by means of a method for assembling the valve drive having the characterizing features of claims 2 or 3. According to said method, in order to form each module from one of the groups, the cam follower is fixed in a measuring or testing device and one or more features of the cam follower are determined. On the basis of said measurement or testing values and the total installation dimension assigned to the group, the cam follower thereupon has assigned to it a support element with a predetermined installation height and/or with predetermined diameter of the spherical end. If appropriate, in a further method step, the cam follower is captively connected by means of the connecting element. In the case of multiple groups of modules, it is expediently provided that each module of a group is characterized in order to identify the total installation dimension assigned to the group.

In addition, the assembly of the valve drive into the cylinder head should preferably take place, in the case of multiple groups of modules, with at least the method steps described below. Said method steps firstly comprise determining one or more features of the cylinder head, of the camshaft and of the gas-exchange valve. In said method step, the gas exchange valve is assembled in the cylinder step, while the features of the camshaft are expediently determined outside the cylinder head. On the basis of said measurement or testing values and the level of the nominal valve play which is to be set, the required total installation dimension of the module is thereupon determined for each gas exchange valve of the cylinder head. Subsequently, each gas exchange valve is to be assigned a module from the group which is assigned the total installation dimension determined in this way, and each module followed by the camshaft is to be assembled into the cylinder head.

A significant advantage of said assembly method is that the intermediate step of provisionally installing the valve drive into the cylinder head for measuring or testing the actual valve play and the disassembly, which is then possibly required, of the valve drive for the purpose of exchanging a valve drive component which adjusts the valve play to the nominal valve play can be dispensed with. The method according to the invention in fact corresponds to an indirect determination of the valve play, by virtue of the previously stated features being determined when the valve drive is still disassembled and are evaluated taking into consideration the nominal valve play which is to be set. A total installation dimension of the group of modules is then defined as a result of said evaluation, the cam followers of which group has an actual valve play within the nominal valve play already after the first assembly of the valve drive into the cylinder head.

If only one group of modules with identical installation dimension is provided in connection with the adjusting means, which are to be assembled separately thereto, for valve play adjustment, a method for assembling the valve drive into the cylinder head is alternatively provided which then comprises the following method steps. Again, the determination of one or more features of the cylinder head, of the camshaft and of the gas exchange valve firstly takes place. Each gas exchange valve of the cylinder head is then to be assigned the adjusting means on the basis of said measurement or testing values and as a function of the nominal valve play, and each adjusting means is to be assembled into the cylinder head. Each module followed by the camshaft is thereupon to be assembled into the cylinder head.

In correlation with the former method for assembling the valve drive into the cylinder head, this method is also based on the previously explained indirect determination of the valve play. After evaluating the determined measurement or testing values, each gas exchange valve can then be assigned that adjusting means which, in connection with the module, generates an actual valve play within the nominal valve play already after the initial assembly of the valve drive into the cylinder head. A direct measurement or testing of the valve play after assembly of the valve drive into the cylinder head can nevertheless be provided in both of said methods for inspection purposes, and does not contradict the disclosed concept of the invention.

BRIEF DESCRIPTION OF THE DRAWINGS

Further features and embodiments of the invention can be gathered from the following description and from the drawings, in which the valve drive according to the invention is illustrated by way of example on the basis of a rocker arm valve drive. In the drawings.

DETAILED DESCRIPTION OF THE DRAWINGS

Figure 1:
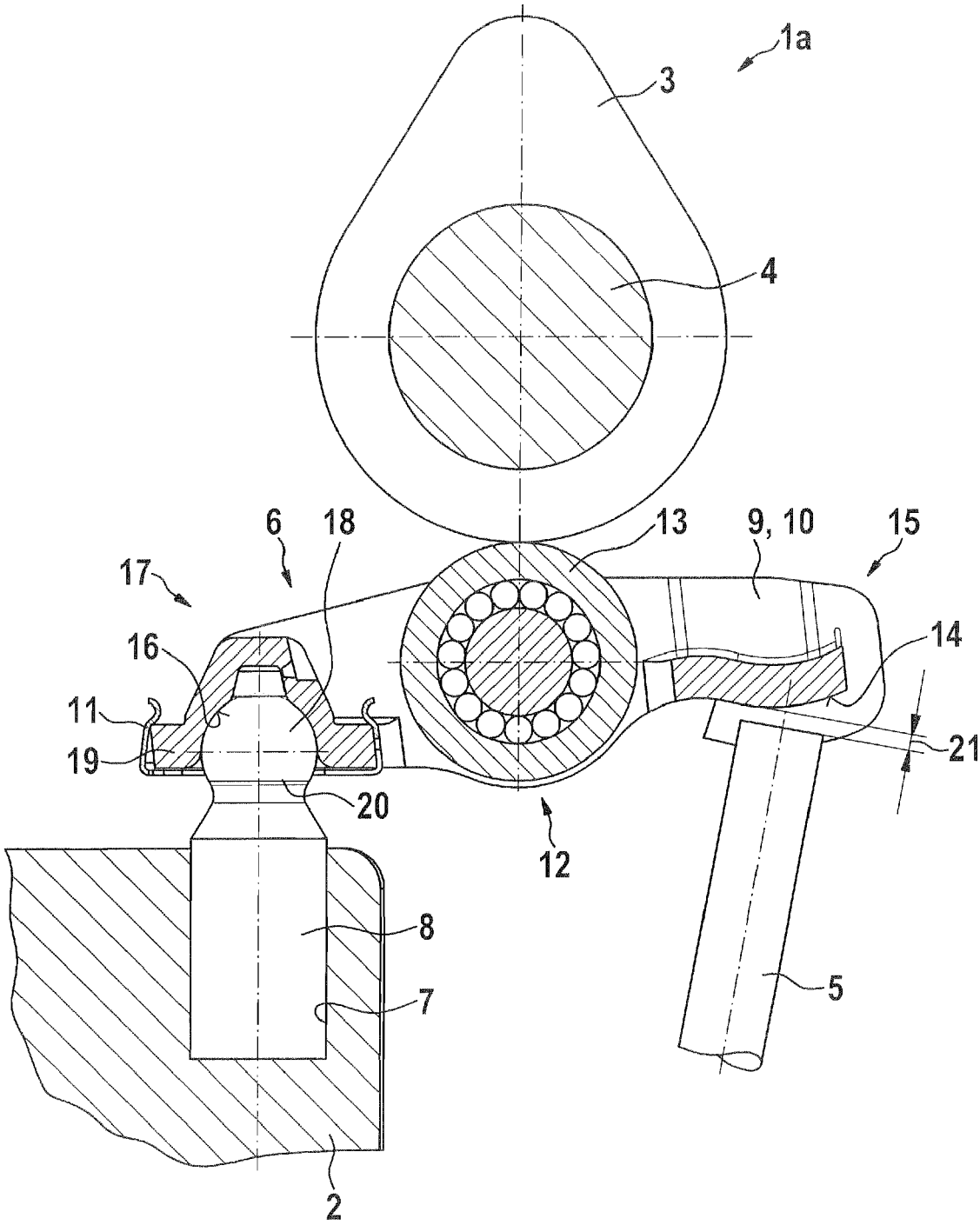
FIG. 1 shows a simplified section illustration of a first embodiment variant of the rocker arm valve drive in the assembled state of the cylinder head.

FIG. 1 discloses a first embodiment variant of a valve drive 1*a* with mechanical valve play adjustment in a cylinder head 2 of an internal combustion engine having components which are essential to the invention. The valve drive 1*a* comprises a cam 3 of a camshaft 4, a gas exchange valve 5 and a module 6 which is composed of a support element 8 which is mounted so as to rest in a hollow cylindrical recess 7 of the cylinder head 2, a cam follower 10 which is embodied as a rocker arm 9, and a connecting element 11 for captively retaining the rocker arm 9 on the support element 8. The rocker arm 9 is acted on, in a central region 12, by the cam 3 via a roller 13, which is mounted by means of rolling bearings, as a low-friction run-on face, and actuates, with a convexly-formed valve shank rest 14 at a first end region 15, the gas exchange valve 5. The rocker arm 9 is also pivotably mounted, with a spherical-cap-shaped formation 16 at a second end region 17, on a spherical end 18 of the support element 8, wherein the connecting element 11 is fastened to a base 19, which surrounds the formation 16, by means of a snap-action connection which is known per se, and engages in a form-fitting manner around a diameter constriction 20 of the support element 8 below the spherical end 18. A valve play 21 which occurs when the gas exchange valve 5 is closed can be measured or tested both between the roller 13 and the cam 3 and also between the valve shank rest 14 and the gas exchange valve 5.

The support element 8 and the rocker arm 9 are paired outside the cylinder head to form the module 6, in such a way that said module 6 can be sorted into one of a plurality of groups of modules 6 with in each case a defined total installation dimension. As has already been explained in the introduction, the term "total installation dimension" is, in summary, to be understood to mean that rocker arms 9 of units 6 with the same total installation dimension in the same component environment have the same valve play 21. The range of the total installation dimension in relation to the entirety of the groups is selected here such that a valve play adjustment to a nominal valve play is possible within the total range of variation of features of the cylinder head 2, of the camshaft 4 and of the gas exchange valve 5.

Figure 2:
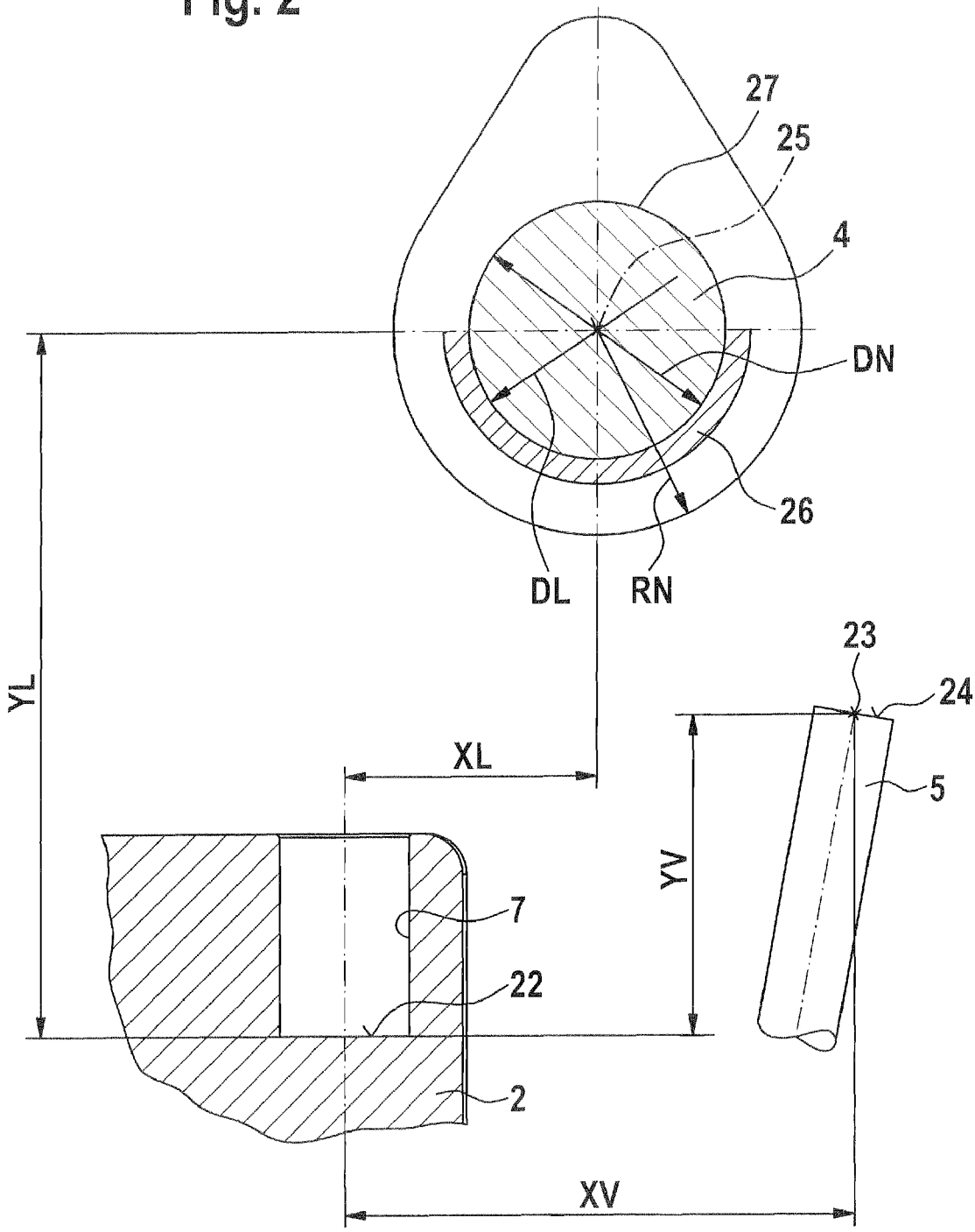
FIG. 2 shows an exemplary dimensional diagram of cylinder-head-side features.

Said features are illustrated on the basis of an exemplary dimensional diagram in FIG. 2, and are initially to be measured or tested. The point of intersection of the longitudinal axis of the recess 7 with a base 22 of the recess 7 serves as a reference point. Proceeding from here, the coordinates XV and YV denote a central point 23 on an end face 24, which faces toward the rocker arm 9, of the gas exchange valve 5 which is assembled in the cylinder head 2. The coordinates XL and YL indicate the central point 25 of the cylinder head bearing point 26 for the camshaft 4 as a measure for the rotational axis of the latter, while DL denotes the diameter of the cylinder head bearing point 26 including a bearing cover which is possibly used but is not illustrated. The features of the camshaft 4 are the diameter DN of a camshaft bearing 27 and the radius RN of the cam base circle. Although the camshaft 4 is illustrated in FIG. 2 in the assembled state of the cylinder head 2, the measurement or testing of its said features expediently takes place outside the cylinder head 2.

Depending on the sensitivity of the valve play 21 to fluctuations in the above-stated features XV, YV, XL, YL, DL, DN, RN, it however need not be strictly necessary to determine all the features of the cylinder head 2, of the gas exchange valve 5 or of the camshaft 4. For example, measurement or testing of the coordinate XL could be dispensed with, since its fluctuation on account of the kinematic conditions between the cam 3 and the roller 13 brings about only a comparatively minor and possibly negligible variation in the valve play 21. In contrast, a fluctuation of the coordinate YL influences the valve play 21 significantly, and is preferably to be taken into consideration in the measurement or testing of the cylinder-head-side features XV, YV, XL, YL, DL. With the knowledge of one or more of said measurement or testing values, and of the level of the nominal valve play which is to be set, in a subsequent method step for assembling the valve drive 1*a* into the cylinder head 2, the required total installation dimension of the module 6 is determined for each gas exchange valve 5.

Figure 3:
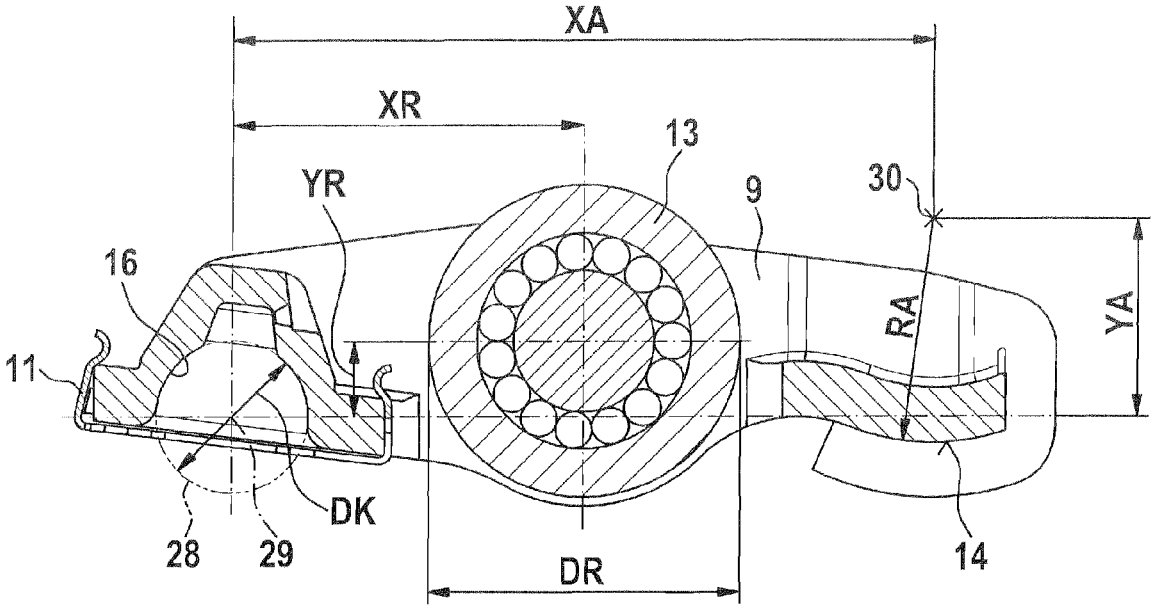
FIG. 3 shows an exemplary dimensional diagram of features of the rocker arm.

The pairing of the support element 8 with the rocker arm 9 in order to form the module 6 with a defined total installation dimension can take place both on demand and at the same time as the assembly and also in the run-up to the assembly of the valve drive 1*a* into the cylinder head 2. A preferred method for said pairing is explained below on the basis of FIGS. 3 and 4. Firstly, the rocker arm is fixed in a measurement or testing device (not illustrated in any more detail), and the features of said rocker arm are determined. For this purpose, the rocker arm 9 is mounted with its spherical-cap-shaped formation 16 on a testing ball 28 of the device, with a central point 29 of the testing ball 28 serving as a reference for the subsequent measurement or testing of said features according to the dimensional diagram likewise illustrated here by way of example. Proceeding from the central point 29 of the testing ball 28 with a known diameter DK, the spatial position of the roller 13, whose diameter is DR, is given by the horizontal spacing XR and the vertical spacing YR. Similarly, XA and YA denote the position of a central point 30 of the circular-arc-shaped valve shank rest 14 with the radius RA. According to the above statements, it can also be sufficient here, depending on the sensitivity of the valve play 21 to fluctuations in the features XR, YR, DR, XA, YA, RA, to determine only some of said features.

Figure 4:
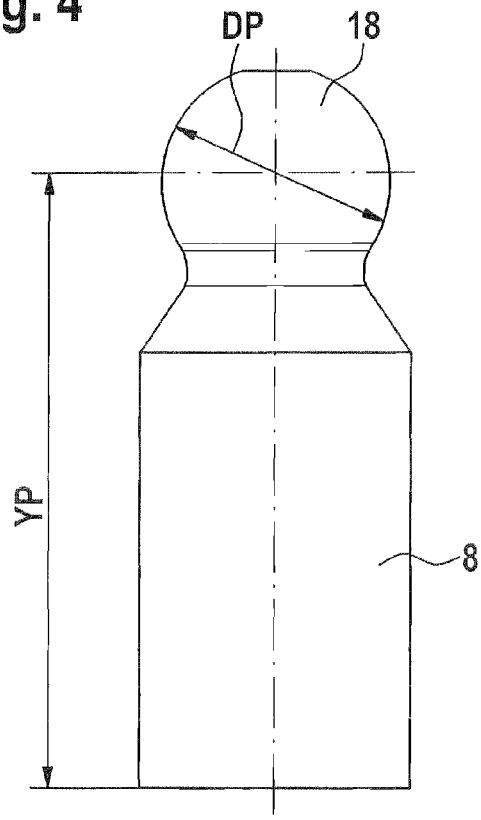
FIG. 4 shows an exemplary dimensional diagram of features of the support element.

In a further method step, in order to form the module 6, the rocker arm 9 is, on the basis of the previously determined measurement or testing values and of the total installation dimension assigned to the corresponding group, assigned a support element 8, which is stepped in height, with a predetermined installation height YP and/or with a predetermined diameter DP of the spherical end 18 as features of the support element 8 as per FIG. 4. Alternatively to the pairing of the rocker arm 9 to a support element 8 which is stepped in height, it is of course also possible to use support elements 8 with a constant installation height YP and to assign these in each case a rocker arm 9 whose features XR, YR, DR, XA, YA, RA are targetedly sought or set with regard to the total installation dimension.

In a subsequent method step, in order to form the module 6, the rocker arm 9 which is paired with the support element 8 is captively connected by means of the connecting element 11 to the module 6. Finally, it can also be provided to characterize the modules 6 which are sorted into groups in order to identify the total installation dimension assigned to the respective group. The type of said characterization can take place using suitable means known to a person skilled in the art and is not explained in any more detail at this point.

In a further method step for assembling the valve drive 1*a* into the cylinder head 2, it is provided, subsequently to the previously described determination of the required total installation dimension of the module 6, that each gas exchange valve 5 of the cylinder head 2 is assigned a module 6 from that group which is assigned the determined total installation dimension, and each module 6 is assembled into the cylinder head 2. The camshaft 4 is subsequently to be assembled into the cylinder head 2.

Figure 5:
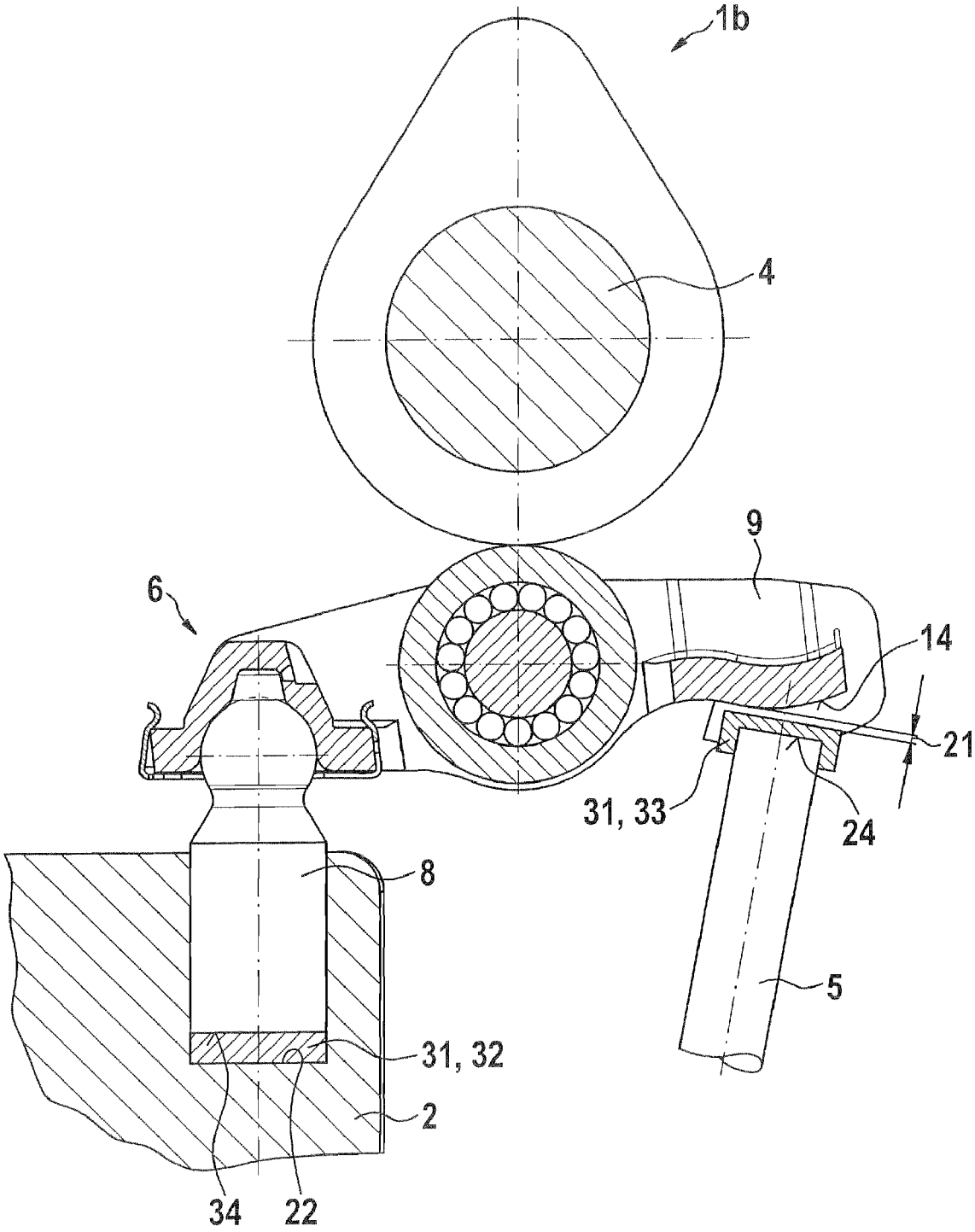
FIG. 5 is a simplified section illustration of a second embodiment variant of the rocker arm valve drive in the assembled state of the cylinder head.

A second embodiment variant of a valve drive 1*b* according to the invention is disclosed in FIG. 5. In contrast to the first embodiment variant 1*a*, here, only one group of modules 6 is provided with a substantially identical total installation dimension. The formation of said module 6 takes place similarly to the method described above, but on account of the uniform total installation dimension, without said group sorting. Here, an adjusting means 31 which can be assembled into the cylinder head 2 separately from the module 6 serves for adjusting the valve play 21. The adjusting means 31 can be embodied as an adjusting disk 32 which is of stepped thickness or as an adjusting flap 33 which is of stepped thickness, and can be used selectively or in combination. Here, the adjusting disk 32 is arranged between the base 22, which supports the support element 8, in the cylinder head 2 and an end side 34, which faces towards the base 22, of the support element 8, while the valve adjusting flap 33 is arranged between the end face 24 of the gas exchange valve 5 and the valve shank rest 14 of the cam follower 10.

For the assembly of the valve drive 1*b* which is formed in this way into the cylinder head 2, the following method steps are provided. In correlation with the first embodiment variant of the valve drive 1*a*, the features XL, YL, DL of the cylinder head 2, the features DN, RN of the camshaft 4 and the features XV, YV of the gas exchange valve 5 are again firstly determined. On the basis of said measurement or testing values, and of the level of the nominal valve play which is to be set, each gas exchange valve 5 is subsequently assigned the adjusting disk 32 and/or the valve adjusting flap 33, and is assembled in the cylinder head 2. The modules 6 followed by the camshaft 4 are thereupon assembled into the cylinder head 2.

It is finally also to be pointed out that, although an essential concept of the invention consists in the formation of the modules 6 with a defined total installation dimension, which permits assembly-compatible adjustment of the valve play 21 in particular during the initial assembly of the valve drive 1*a*, 1*b* into the cylinder head 2, this however does not exclude the known methods of valve play adjustment within the context of servicing of the internal combustion engine, in which the valve play 21 is measured or tested directly between the rocker arm 9 and the cam 3 or the gas exchange valve 5 before the adjustment of said valve play 21. In addition, it is then possible, for the adjustment of the valve play 21, for separation of the module 6 to also be provided, wherein for example the support element 8 is exchanged for a support element 8 with a different installation height YP and is re-connected to the rocker arm 9 and to the connecting element 21 in order to form a module 6 with a changed total installation dimension.

LIST OF REFERENCE SYMBOLS

1*a,b* Valve drive
2 Cylinder head
3 Cam
4 Camshaft
5 Gas exchange valve
6 Module
7 Recess
8 Support element
9 Rocker arm
10 Cam follower
11 Connecting element
12 Central region
13 Roller
14 Valve shank rest
15 First end region
16 Formation
17 Second end region
18 Spherical end
19 Base
20 Diameter constriction
21 Valve play
22 Base
23 Central point
24 End face
25 Central point
26 Cylinder head bearing point
27 Camshaft bearing
28 Testing ball
29 Central point
30 Central point
31 Adjusting means
32 Adjusting disk
33 Valve adjusting cap
34 End side

The invention claimed is:

1. A cylinder head of an internal combustion engine with mechanical valve play adjustment, comprising:

a valve drive for actuating a gas exchange valve, the valve drive having a lever-like cam follower arranged between a cam of a camshaft and the gas exchange valve, which cam follower is mounted on a support element, which is stationary in the cylinder head, with a rigid installation height and, for adjustment of the valve play with respect to the cam and/or the gas exchange valve, is dimensionally paired with the support element, wherein a module comprises the support element, which is mounted in a cylinder recess of the cylinder head of the cam follower that has a base opposing the cylinder head and a connecting element, which has a bottom wall with an opening and upwardly extending flanges that surround transverse outer walls of the base of the cam follower, captively retaining the cam follower on the support element by a snap-action, and which module has a defined total installation dimension, and whereby without readjustment after initial assembly of the valve drive into the cylinder head, the actual valve play within a nominal valve play is ensured.

2. The cylinder head of claim 1, wherein one or more groups of modules are provided, which modules have cam followers and support elements which are paired such that all the modules of the same group have an at least approximately identical total installation dimension, and that all the modules of another group have a different total installation dimension thereto.

3. The cylinder head of claim 2, wherein only one group of modules is provided in connection with an adjusting means, which can be mounted separately from the module in the cylinder head, for adjusting the valve play.

4. The cylinder head of claim 3, wherein the adjusting means is embodied as an adjusting disk which is of stepped thickness and/or as a valve adjusting flap which is of stepped thickness, wherein the adjusting disc is arranged between a base, which supports the support element, in the cylinder head and an end side, which faces towards the base, of the support element, and wherein the valve adjusting flap is arranged between an end face, which faces towards the cam follower, of the gas exchange valve and a valve shank rest, which faces towards the end face, of the cam follower.

5. The cylinder head of claim 1, wherein the cam follower is embodied as a rocker arm which, with a convex valve shank rest at a first end region, actuates the gas exchange valve, with a spherical-cap-shaped formation at a second end region, is pivotably mounted on a spherical end of the support element and is acted on by means of a roller, which is rotatable and optionally mounted by means of rolling bearings, in a central region by the cam, with the connecting element, which, as a shaped part produced in a non-cutting process, is composed of cold-hammered sheet metal material, engaging in a form-fitting manner around a diameter constriction below the spherical end.

6. A method for mounting the cylinder head of claim 2, comprising the following steps:

assembling a valve drive;

forming a module from one of the groups;

fixing the cam follower in a measuring or a testing device; and determining one or more spatial positions and/or dimensional dimensions of elements, which influence the valve play, of the cam follower, determined, whereupon the cam follower being assigned, on a basis of measurement or testing values and the total installation dimension assigned to one of the groups, a support element with a predetermined installation height and/or with predetermined diameter of a spherical end.

7. The method as claimed in claim 6, wherein, in the case of a plurality of groups, each module of a group is characterized in order to identify the total installation dimension assigned to the group.

8. The method as claimed in claim 6, wherein the assembly of the valve drive into the cylinder head takes place with at least one of the following method steps:

determining one or more spatial positions and/or dimensional dimensions of elements, which influence the valve play, of the cylinder head and/or of the camshaft and/or of the gas-exchange valve;

determining, for each gas exchange valve of the cylinder head, the required total installation dimension of the module on the basis of said measurement or testing values and as a function of the nominal valve play;

assigning each gas exchange valve a module from the group which is assigned the total installation dimension determined in this way, and assembling each module into the cylinder head; and assembling the camshaft into the cylinder head.

9. The method as claimed in claim 6, wherein the assembly of the valve drive into the cylinder head takes place with at least one of the following method steps:

determining one or more spatial positions and/or dimensional dimensions of elements, which influence the valve play, of the cylinder head and/or of the camshaft and/or of the gas-exchange valve;

assigning each gas exchange valve of the cylinder head the adjusting means on the basis of said measurement or testing values and as a function of the nominal valve play, and assembling each adjusting means into the cylinder head;

assembling each module into the cylinder; and assembling the camshaft into the cylinder head.

* * * * *